US010443435B2

(12) United States Patent
Hayford et al.

(10) Patent No.: US 10,443,435 B2
(45) Date of Patent: Oct. 15, 2019

(54) SLOTS FOR TURBOMACHINE STRUCTURES

(71) Applicant: United Technologies Corporation, Farmington, CT (US)

(72) Inventors: Richard K. Hayford, Cape Neddick, ME (US); Michael J. Bruskotter, Cape Neddick, ME (US); Ross A. Vandenbosch, Berwick, ME (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 1018 days.

(21) Appl. No.: 14/969,426

(22) Filed: Dec. 15, 2015

(65) Prior Publication Data

US 2016/0169039 A1 Jun. 16, 2016

Related U.S. Application Data

(60) Provisional application No. 62/091,737, filed on Dec. 15, 2014.

(51) Int. Cl.

| | |
|---|---|
| ***F01D 25/24*** | (2006.01) |
| ***F01D 25/12*** | (2006.01) |
| ***F01D 9/04*** | (2006.01) |
| ***F01D 11/18*** | (2006.01) |

(52) U.S. Cl.

CPC ..... *F01D 25/12* (2013.01); *F01D 9/04* (2013.01); *F01D 11/18* (2013.01); *F01D 25/24* (2013.01); *F01D 25/246* (2013.01); *F05D 2260/221* (2013.01); *F05D 2260/941* (2013.01)

(58) Field of Classification Search

CPC ..... F01D 25/24; F01D 25/243; F01D 25/246; F01D 11/18; F01D 9/04; F01D 9/041

See application file for complete search history.

(56) References Cited

U.S. PATENT DOCUMENTS

| | | | | |
|---|---|---|---|---|
| 5,593,276 | A | 1/1997 | Proctor et al. | |
| 8,167,546 | B2 * | 5/2012 | Shi | F01D 9/04 415/173.1 |
| 9,080,463 | B2 * | 7/2015 | Denece | F01D 9/04 |
| 2006/0013685 | A1 | 1/2006 | Ellis et al. | |
| 2011/0023496 | A1 | 2/2011 | Bastnagel et al. | |

(Continued)

FOREIGN PATENT DOCUMENTS

| | | |
|---|---|---|
| JP | 2004076818 | 3/2004 |

OTHER PUBLICATIONS

European Search Report for Application No. 15200038.6-1610; dated May 12, 2016; 6 pgs.

(Continued)

*Primary Examiner* — Justin D Seabe
(74) *Attorney, Agent, or Firm* — Cantor Colburn LLP

(57) ABSTRACT

A component for a turbomachine includes an annular body defining an inner diameter portion and an outer diameter portion, and a crack guiding slot defined in a surface of the annular body extending from the inner diameter portion radially outward toward the outer diameter portion or extending from the outer diameter portion radially inward toward the inner diameter portion. The outer diameter portion can be mountable to a stationary structure of a turbomachine. The inner diameter portion can be mountable to a turbine vane.

16 Claims, 4 Drawing Sheets

(56) References Cited

U.S. PATENT DOCUMENTS

| | | | | |
|---|---|---|---|---|
| 2015/0089957 | A1* | 4/2015 | Schwartz | F02C 7/20 60/796 |
| 2017/0248027 | A1* | 8/2017 | Schiavo | F01D 11/005 |

OTHER PUBLICATIONS

EP Office Action dated Feb. 1, 2018 for Application No. 15 200 038.6.

* cited by examiner

SLOTS FOR TURBOMACHINE STRUCTURES

CROSS REFERENCE TO RELATED APPLICATIONS

This application claims the benefit of U.S. Provisional Patent Application Ser. No. 62/091,737 filed Dec. 15, 2014, the entire contents of which are incorporated herein by reference thereto.

BACKGROUND

1. Field

The present disclosure relates to turbomachine structures, more specifically to systems and methods for managing the effects of thermal stress on turbomachine components.

2. Description of Related Art

It is common to have high stresses in full-ring or annular structures in turbomachines that are subjected to thermal gradients due to differences in expansion caused by the differences in local temperatures in the annular structure. If the stress issue is not addressed, fatigue cracks can initiate randomly around the circumference of the ring structure. A common method to address the stress problem is to "slot" completely through the thickness of the part, through some portion of the length thereof (radial or axial or both), to a location usually towards the middle of the part where stresses are low enough not to initiate fatigue cracks.

These slots may solve the stress problem and stop fatigue cracking, however, the problem with current methods of slotting is that conventional manufacturing processes will inherently leave a slot of a certain width (or gap), typically greater than 0.010" wide, due to the width of the cutting tool or process (milling, grinding, sawing, wire electro-discharge machining, abrasive water jet, laser, plasma etc.). The resulting slot will then provide a leak path for gasses if there is any pressure difference across the thickness of the part. This leakage can be particularly undesirable if the higher pressure gas is needed elsewhere in the machine to provide cooling of other parts or components or result in a loss in efficiency.

Such conventional methods and systems have generally been considered satisfactory for their intended purpose. However, there is still a need in the art for improved annular structures for turbomachines. The present disclosure provides a solution for this need.

SUMMARY

A component for a turbomachine includes an annular body defining an inner diameter portion and an outer diameter portion, and a crack guiding slot defined in a surface of the annular body extending from the inner diameter portion radially outward toward the outer diameter portion or extending from the outer diameter portion radially inward toward the inner diameter portion. The outer diameter portion can be mountable to a stationary structure of a turbomachine. The inner diameter portion can be mountable to a turbine vane.

The crack guiding slot can be V-shaped in cross-section. The crack guiding slot can be U-shaped in cross-section. In certain embodiment, the crack guiding slot can include one flat surface and one curved surface in cross-section. The crack guiding slot can extend into the surface of the annular body to a depth of up to about 80% of the thickness of the annular body proximate the crack guiding slot.

A crack arresting hole can be defined at a radially outward terminus of the crack guiding slot. The crack arresting hole can be defined in the annular body to the same depth as the crack guiding slot. It is also contemplated that the crack arresting hole can be defined through the entire thickness of the annular body.

The crack guiding slot can be one of a plurality of crack guiding slots, each spaced apart in a predetermined circumferential pattern. A respective crack arresting hole for each crack guiding slot can be defined at a radially outward terminus of each crack guiding slot.

A method includes forming a turbomachine component support, the component support including an annular body defining an inner diameter portion and an outer diameter portion, and defining a crack guiding slot in a surface of the annular body extending from the inner diameter portion radially outward toward the outer diameter portion or extending from the outer diameter portion radially inward toward the inner diameter portion. The component support can be a vane support.

Defining the crack guiding slot can include defining a V-shaped slot in cross-section. In certain embodiments, defining the crack guiding slot can include defining one flat surface and one curved surface in the slot. Defining the crack guiding slot can include defining a U-shaped slot in cross-section. In certain embodiments, defining the crack guiding slot can include defining the slot into the surface of the annular body to a depth of up to about 80% of the thickness of the annular body proximate the crack guiding slot.

The method can further include disposing a crack arresting hole at a radially outward terminus of the crack guiding slot. Disposing the crack arresting hole can include defining the crack arresting hole in the annular body to the same depth as the crack guiding slot. In certain embodiments, disposing the crack arresting hole can include defining the crack arresting hole through the entire thickness of the annular body.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
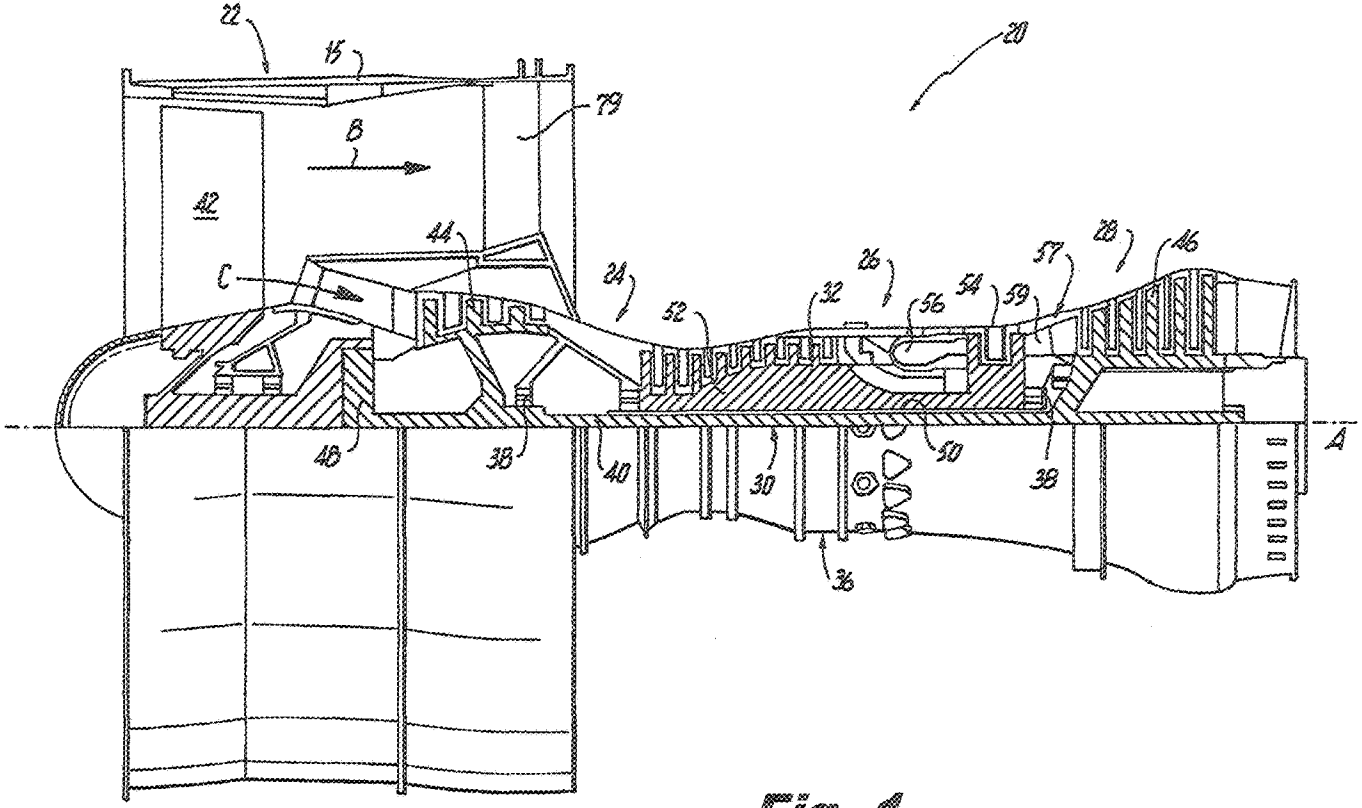
FIG. 1 is a partial, side cross-sectional schematic view of an embodiment of a turbomachine in accordance with this disclosure.
Figure 2:
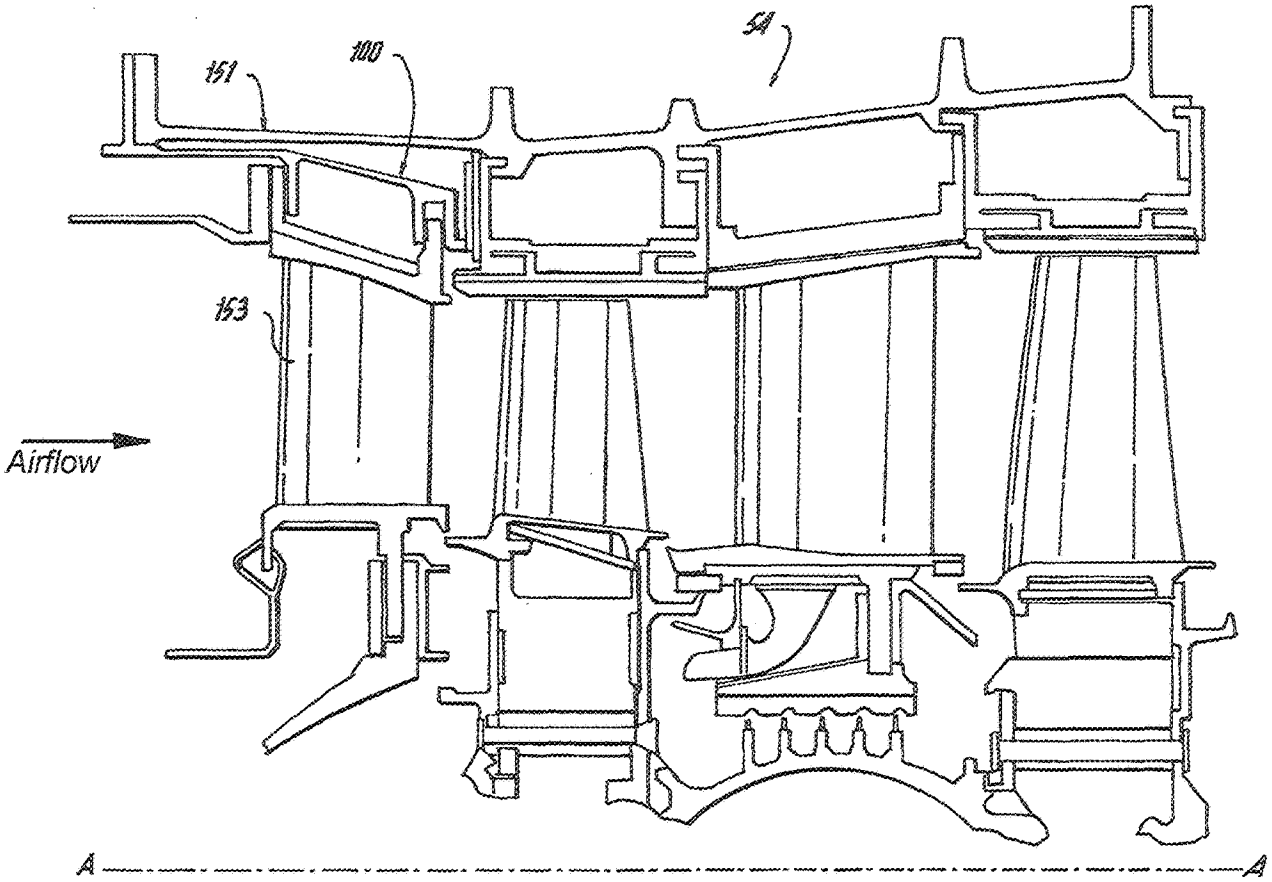
FIG. 2 is a partial cross-sectional schematic view of a turbine section of the turbomachine of FIG. 1, showing a vane support disposed therein and connected to a vane.
Figure 3A:
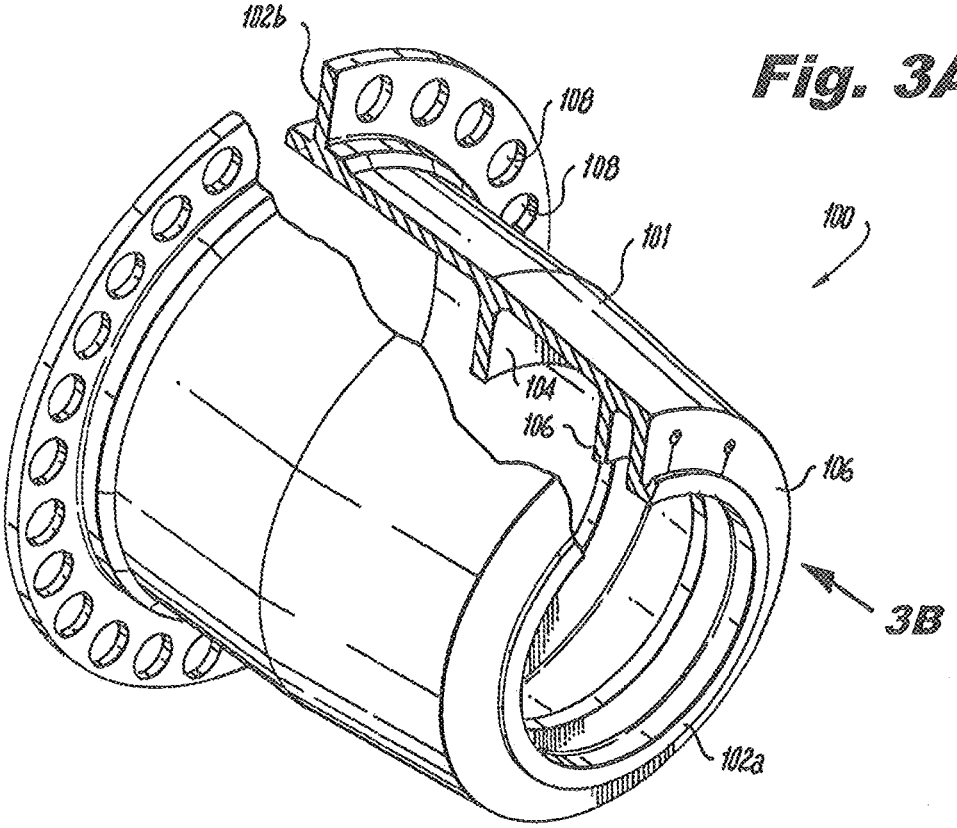
FIG. 3A is a cross-sectional side elevation view of a vane support in accordance with this disclosure.
Figure 4:
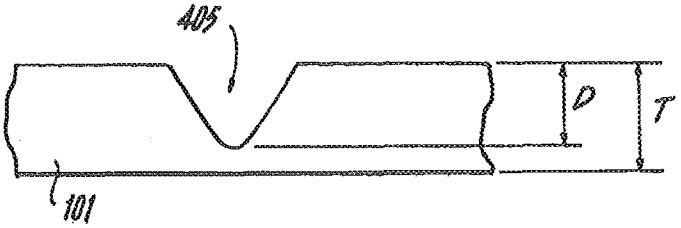
FIG. 4 is a schematic cross-sectional view of a portion of the vane support of FIG. 3A which includes a crack guiding slot, showing a slot with a U-shaped cross-section.
Figure 5:
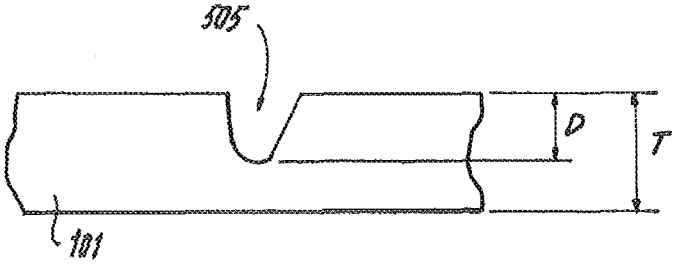
FIG. 5 is a schematic cross-sectional view of a portion of the vane support of FIG. 3A which includes a crack guiding slot, showing a slot with an asymmetric cross-section.

Reference will now be made to the drawings wherein like reference numerals identify similar structural features or aspects of the subject disclosure. For purposes of explanation and illustration, and not limitation, an illustrative view of an embodiment of a vane support in accordance with the disclosure is shown in FIGS. 2-3C and is designated generally by reference character 100. Other embodiments and or aspects of this disclosure are shown in FIGS. 1, 4, and 5. The systems and methods described herein can be used to control component cracking due to thermally induced material stress.

FIG. 1 schematically illustrates a turbomachine, such as gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane 79 ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tram ° R)/(518.7° R)]^0.5. The "Low corrected fan tip speed" as disclosed herein according to one non-limiting embodiment is less than about 1150 ft/second (350.5 meters/second).

Figure 3B:
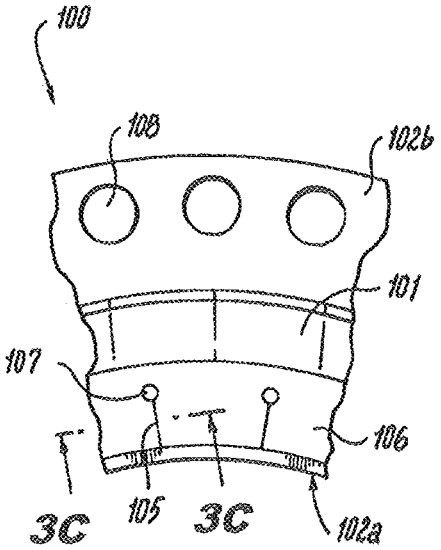
FIG. 3B is a partial front elevation view of the vane support of FIG. 3A, showing the crack guiding slots.
Figure 3C:
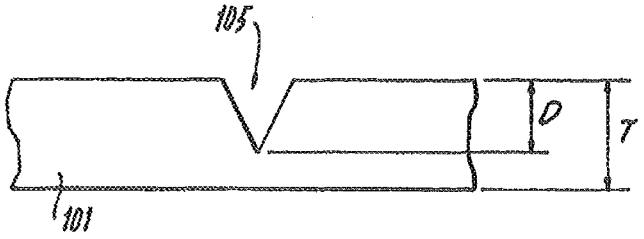
FIG. 3C is a schematic cross-sectional view of a portion of the vane support of FIG. 3A which includes a crack guiding slot, showing a slot with a V-shaped cross-section.

Referring to FIGS. 2-3C, a component for a turbomachine (e.g., vane support 100) includes an annular body 101 defining an inner diameter portion 102*a* and an outer diameter portion 102*b*. Referring specifically to FIG. 3B, one or more crack guiding slots 105 are defined in a surface of the annular body 101 (e.g., on extension 106). The slots 105 can extend from the inner diameter portion 102*a* radially outward toward the outer diameter portion 102*b*. In certain embodiments, one or more crack guiding slots 105 can alternatively or additionally extend from the outer diameter portion 102*b* toward the inner diameter portion 102*a*.

As shown in FIG. 2, the outer diameter portion 102*b* can be mounted to a stationary structure 151 of a turbomachine (e.g., part of the turbine section 54 casing) via mounting holes 108. Also as shown, the inner diameter portion 102*a* can be mounted to a turbine vane 153. For example, the turbine vane 153 can be at least partially mounted to at least one extension 104, 106.

Referring additionally to FIG. 3C, the crack guiding slot 105 can be V-shaped in cross-section. Referring to FIG. 4, in certain embodiments, a crack guiding slot 405 can include a U-shaped cross-section. In certain embodiments, referring to FIG. 5, a crack guiding slot 505 can include one flat surface and one curved surface in cross-section such that the slot 505 is asymmetric. Any other suitable guiding slot cross-section can be used without departing from the scope of this disclosure.

In general, one or more of the crack guiding slots 105 can extend into the surface of the annular body to a depth D of up to about 80% of the thickness T of the annular body 101 proximate the crack guiding slot 105. Any other suitable depth is contemplated as being within the scope of this disclosure (e.g., about 50%, about 95%, about 10%). In certain embodiments, one or more of the crack guiding slots 105 can be defined through the entire thickness of the annular body 101. It is contemplated that the crack guiding slots 105 can be defined to any suitable length, width, cross-sectional shape, and in any suitable surface (e.g., horizontal and/or vertical surfaces) of the annular body 101. It is also contemplated that a crack guiding slot 105 can be defined in the opposite surface of the annular body 101 such that material is removed from both sides (e.g., such that there are two V cuts with aligned apexes cut from both sides).

A crack arresting hole 107 can be defined at a radially outward terminus of one or more of the crack guiding slot 105. The crack arresting hole 107 can be defined in the annular body 101 (e.g., on extension 106) only partially into the thickness T annular body 101 (e.g., to the same depth as the crack guiding slot 105 or any other suitable depth). This can include a partial hole or recess defined in both sides of the annular body 101, leaving the reduced thickness at the center of the original part thickness. It is also contemplated that the crack arresting hole 107 can be defined through the entire thickness of the annular body 101.

As shown in FIG. 3B, the vane support 100 can include a plurality of crack guiding slots 105, each spaced apart in a predetermined circumferential pattern. A plurality of crack arresting holes 107 for each crack guiding slot 105 can be defined at a radially outward terminus of each crack guiding slot 105. It is contemplated herein that the plurality of crack guiding slots 105 can include a plurality of cross-sectional shapes as disclosed above, or that each can have the same cross-sectional shape. It is also contemplated that not all crack guiding slots 105 of the plurality need to have a crack arresting hole 107 at a terminus thereof and that any number is suitable.

A method includes forming a turbomachine component support (e.g., vane support 100), the component support including an annular body 101 defining an inner diameter portion 102*a* and an outer diameter portion 102*b*. The method also includes defining a crack guiding slot 105 in a surface of the annular body 101 extending from the inner diameter portion 102*a* radially outward toward the outer diameter portion 102*b* or vice versa.

Defining the crack guiding slot 105 can include defining a V-shaped slot in cross-section. In certain embodiments, defining the crack guiding slot 105 can include defining one flat surface and one curved surface in the slot. Defining the crack guiding slot 105 can include defining a U-shaped slot in cross-section. In certain embodiments, defining the crack guiding slot 105 can include defining the slot 105 into the surface of the annular body 101 to a depth of up to about 80% of the thickness of the annular body 101 proximate the crack guiding slot 105.

The method can further include disposing a crack arresting hole 107 at a radially outward terminus of the crack guiding slot 105. Disposing the crack arresting hole 107 can include defining the crack arresting hole 107 in the annular body 101 only partially through the annular body 101 (e.g., to the same depth as the crack guiding slot 105). In certain embodiments, disposing the crack arresting hole can include defining the crack arresting hole 107 through the entire thickness of the annular body 101.

Under thermal stresses over time, the vane support 100 allows for cracks to develop in the crack guiding slots 105. The cracks will tend to form in the crack guiding slots 105 because it is the thinnest and weakest point of material in the annular body 101. Therefore, the cracks can be controlled and limited to the most manageable portions of the vane support leading to increased part life over existing vane supports. In addition, the crack arresting holes 107 can prevent the cracks from advancing too far radially outward.

A benefit of the crack guiding slots 105, when they are not cut entirely through the thickness of the annular body 101, is that there is a deliberate location at the radially inward portion of the crack guiding slots 105 where fatigue cracks will form but only at these weaker, reduced thickness portions of the annular body 101. Once a crack has formed, the width (or gap) between the two sides which have cracked will be extremely small, (e.g., usually much less than 0.001" inches). This gap is much smaller than can be manufactured, and thus minimizes the amount of leakage through the thickness of the annular body 101.

Moreover, forming the crack arresting holes 107 only partially into the thickness T of the annular body 101 from both sides such that the remaining thickness is centered in the thickness T of the annular body 101 can be beneficial to the strength of the annular body 101. Specifically, a bending stress field has maximum stresses at the surfaces, but the stresses approach zero in the center of the part. Therefore, the reduced thickness section of the crack arresting hole 107 would be less likely to crack and the remaining thickness in the partial hole would then prevent gas leakage, or at least minimize leakage if it were to crack.

The methods and systems of the present disclosure, as described above and shown in the drawings, provide for turbomachine components with superior properties including enhanced thermal stress and cracking management. While the apparatus and methods of the subject disclosure have been shown and described with reference to embodiments, those skilled in the art will readily appreciate that changes and/or modifications may be made thereto without departing from the scope of the subject disclosure.

What is claimed is:

1. A structural component for supporting a component of a turbomachine, the structural component comprising:

an annular body extending axially with respect to a center axis of the annular body, the annular body having an inner diameter portion and an outer diameter portion;

a crack guiding slot defined in a surface of the annular body extending from the inner diameter portion radially outward toward the outer diameter portion or extending from the outer diameter portion radially inward toward the inner diameter portion, the crack guiding slot extending into the surface of the annular body to a depth (D) less than a thickness (T) of the annular body proximate the crack guiding slot; and a crack arresting hole defined at a radially outward terminus of the crack guiding slot.

2. The structural component of claim 1, wherein the outer diameter portion is mountable to a stationary structure of the turbomachine.

3. The structural component of claim 1, wherein the inner diameter portion is mountable to a turbine vane.

4. The structural component of claim 1, wherein the crack guiding slot is V-shaped in cross-section.

5. The structural component of claim 1, wherein the crack guiding slot includes one flat surface and one curved surface in cross-section.

6. The structural component of claim 1, wherein the crack guiding slot is U-shaped in cross-section.

7. The structural component of claim 1, wherein the crack guiding slot extends into the surface of the annular body to a depth of up to 80% of the thickness of the annular body proximate the crack guiding slot.

8. The structural component of claim 1, wherein the crack arresting hole is defined through the entire thickness of the annular body.

9. The structural component of claim 1, wherein the crack guiding slot is one of a plurality of crack guiding slots, each spaced apart in a predetermined circumferential pattern.

10. A method, comprising:

forming a turbomachine component support, the component support including an annular body extending axially with respect to a center axis of the annular body, the annular body defining an inner diameter portion and an outer diameter portion;

defining a crack guiding slot in a surface of the annular body extending from the inner diameter portion radially outward toward the outer diameter portion or extending from the outer diameter portion radially inward toward the inner diameter portion, wherein the crack guiding slot extends into the surface of the annular body to a depth (D) less than a thickness (T) of the annular body proximate the crack guiding slot; and disposing a crack arresting hole at a radially outward terminus of the crack guiding slot.

11. The method of claim 10, wherein the component support is a vane support.

12. The method of claim 10, wherein defining the crack guiding slot includes defining a V-shaped slot in cross-section.

13. The method of claim 10, wherein defining the crack guiding slot includes defining one flat surface and one curved surface in the slot.

14. The method of claim 10, wherein defining the crack guiding slot includes defining a U-shaped slot in cross-section.

15. The method of claim 10, wherein defining the crack guiding slot includes defining the slot into the surface of the annular body to a depth of up to 80% of the thickness of the annular body proximate the crack guiding slot.

16. The method of claim 10, wherein disposing the crack arresting hole includes defining the crack arresting hole in the annular body to the same depth as the crack guiding slot.

* * * * *